US007731549B2

(12) United States Patent
Metzler et al.

(10) Patent No.: US 7,731,549 B2
(45) Date of Patent: Jun. 8, 2010

(54) PLUG-TYPE CONNECTOR FOR USE ON A GLOW PLUG AND HAVING AN INTEGRAL PROJECTING BLADE CONTACT

(75) Inventors: Andreas Metzler, Hohenema (AT); Kurt Ellensohn, Götzis (AT); Julio Cesar Vargas Marquez, Wolfsburg (DE)

(73) Assignee: Hirschmann Automotive GmbH, Rankweil/Brederis (AT)

( * ) Notice: Subject to any disclaimer, the term of this patent is extended or adjusted under 35 U.S.C. 154(b) by 24 days.

(21) Appl. No.: 12/168,176

(22) Filed: Jul. 7, 2008

(65) Prior Publication Data

US 2010/0003841 A1 Jan. 7, 2010

(30) Foreign Application Priority Data

Jul. 5, 2007 (DE) ..... 10 2007 031 401

(51) Int. Cl.
*H01R 13/05* (2006.01)

(52) U.S. Cl. ..... 439/825

(58) Field of Classification Search ..... 439/827, 439/825, 668, 669
See application file for complete search history.

(56) References Cited

U.S. PATENT DOCUMENTS

| | | | | |
|---|---|---|---|---|
| 4,326,768 | A * | 4/1982 | Punako | 439/607.18 |
| 4,750,897 | A * | 6/1988 | Neidecker | 439/825 |
| 7,165,982 | B2 | 1/2007 | Hafele | 439/127 |
| 7,357,671 | B2 * | 4/2008 | Wild et al. | 439/583 |

FOREIGN PATENT DOCUMENTS

| | | |
|---|---|---|
| DE | 102005014203 | 10/2006 |

* cited by examiner

*Primary Examiner*—Phuong K Dinh
(74) *Attorney, Agent, or Firm*—Andrew Wilford

(57) ABSTRACT

A plug-in connector for connecting to a glow plug in a diesel engine has a circular cross section and a plastic base body on which at least one strip contact is coaxially provided. The strip contact has a longitudinally extending slit and at least one protruding projection on the base body. After the strip contact is installed on the base body the projection is deformed in such a way that it projects at least partially over at least one web of the strip contact after being deformed.

5 Claims, 2 Drawing Sheets

PLUG-TYPE CONNECTOR FOR USE ON A GLOW PLUG AND HAVING AN INTEGRAL PROJECTING BLADE CONTACT

FIELD OF THE INVENTION

The invention relates to a plug-in connector for connecting to a glow plug in a diesel engine and having a circular cross section and a plastic base body on which at least one strip contact is coaxially provided.

BACKGROUND OF THE INVENTION

A plug-in connector for connecting to a glow plug in a diesel engine is known from DE 10 2005 014 203 [U.S. Pat. No. 7,165,982]. This known plug-in connector has a circular cross section and a plastic base body on which at least one strip contact, preferably multiple strip contacts, are coaxially provided. This known plug-in connector is mounted on a complementary connector provided on the glow plug, so that after the corresponding contacts of the plug-in connector and of the glow-plug connector are joined together the glow plug may be supplied with power, and sensor signals from the glow plug or sensors provided therein may be received.

These plug-in connectors are subjected to very harsh environmental conditions due to their use in and on internal-combustion engines of vehicles. On the one hand, the plug-in connectors are exposed to very large temperature differences, as well as intense vibrations, impacts, shocks, and the like during operation of the internal-combustion engine. However, since the glow plug, or sensors connected via the plug-in connector to an engine control system, must detect parameters of the internal-combustion engine that are absolutely necessary for engine control, it is important that contact be guaranteed at all times when the plug-in connector and mating connector are joined together. This may be ensured by corresponding complicated measures which, however, are in conflict with economical development and manufacture of such plug-in connectors for diesel engines.

DE 10 2005 014 203 discloses only a plug-in connector having a base body on which multiple strip contacts are provided one behind the other. The manner in which the strip contacts are provided on the base body and manufactured as such is not disclosed in this prior art.

OBJECT OF THE INVENTION

The object of the present invention, therefore, is to provide a plug-in connector and a manufacturing method for such a plug-in connector for connecting to a glow plug in a diesel engine, and that may be reliably and economically manufactured in large numbers and also meets the requirements for reliable contact for use in internal-combustion engines in vehicles.

SUMMARY OF THE INVENTION

According to the invention, the strip contact has a longitudinally extending slit and at least one protruding projection on the base body, and after the strip contact is installed on the base body the projection is deformed in such a way that it overlies at least partially over at least one longitudinal web of the strip contact after being deformed. By use of this design of a plug-in connector according to the invention it is possible to reliably and economically manufacture such a plug-in connector in large numbers while at the same time meeting the requirements for operation in the internal-combustion engine. The radially positioned strip contact may be produced in a stamping/bending process, and because of the longitudinal slit the strip contact remains expanded so that it can be pushed over the circular base body of the plug-in connector during installation. This primarily provides for simple manufacture and installation of the strip contact on the base body. To ensure a reliable contact it is further provided that the base body has at least one protruding projection, in particular multiple (radially protruding) projections over which the strip contact is pushed. This projection or projections may be provided on the base body, for example in the region of the slit in the strip contact or in a space formed by multiple longitudinal webs of the strip contact. After the strip contact has been mounted in the desired position on the base body, it is preferably further deformed (compressed) so that it comes into contact with the base body. After this is done, the projection is at least partially deformed so that it projects over at least one longitudinal web of the strip contact. As a result of this deformation (cold or hot shaping, for example caulking) the strip contact is reliably and permanently affixed to the base body, thereby preventing the strip contact from expanding further and thereby pulling off the base body. This combination of a longitudinal slit in the strip contact and a plastically deformable projection on the base body thus advantageously allows such a plug-in connector to be economically and reliably manufactured, particularly in large numbers, while at the same time ensuring durability, in particular reliable contacting, during operation of the plug-in connector on the internal-combustion engine. Most important, it is no longer necessary to design the strip contact (in shape or material) or install it so that it lies flush against the base body. According to the invention, the expanded strip contact is preferably pressed onto the base body in an automated process so that it lies flush at that location, and the projection/projections is/are then plastically deformed in a permanent manner (likewise preferably in an automated process), so that the strip contact permanently lies flush against the base body. This allows an inexpensive material to be used for the strip contact, since the strip contact no longer needs to be able to maintain its shape after it is widened, pushed over the base body, and then compressed.

The one or more projections that protrude from the base body in particular are located in a region in which the slit in the strip contact mounted on the base body is provided. This has the advantage that the strip contact together with the projections that have been deformed are provided in a region on the base body that most effectively fixes the bendable strip contact to the base body. Alternatively or additionally, projections may also be provided in the radial progression of the strip contact that are deformed for the purpose of fixing the strip contact to the base body.

For the deformation of the projections it is important to make sure that the surface of the deformed projections lies on a radius which is smaller than the contact radius of the strip contacts.

BRIEF DESCRIPTION OF THE DRAWING

The invention is further described on the basis of one embodiment, to which, however, the invention is not limited, and with reference to the figures in which.

SPECIFIC DESCRIPTION

Figure 1:
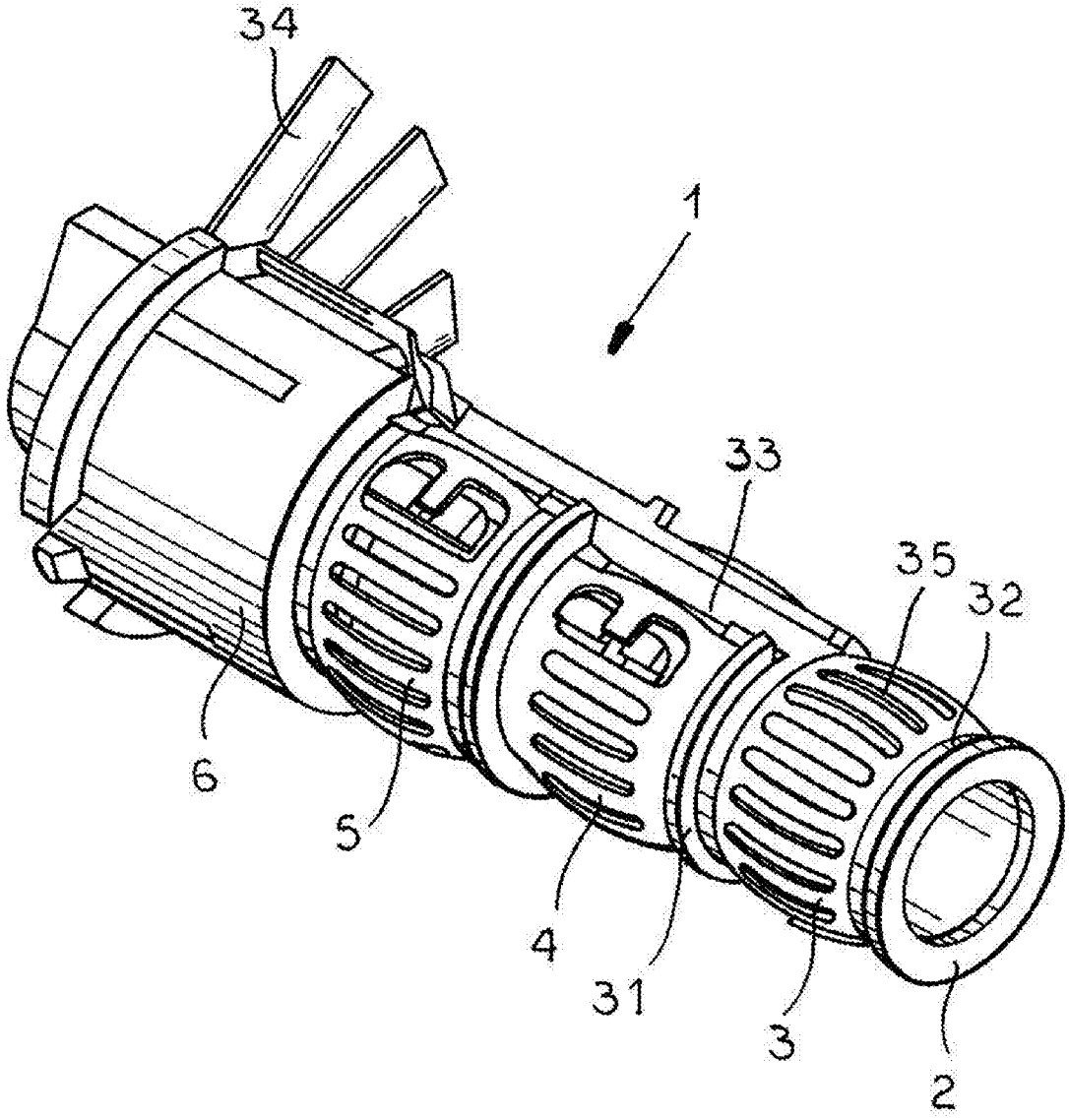
FIG. 1 is a perspective view of the connector according to the invention.
Figure 2:
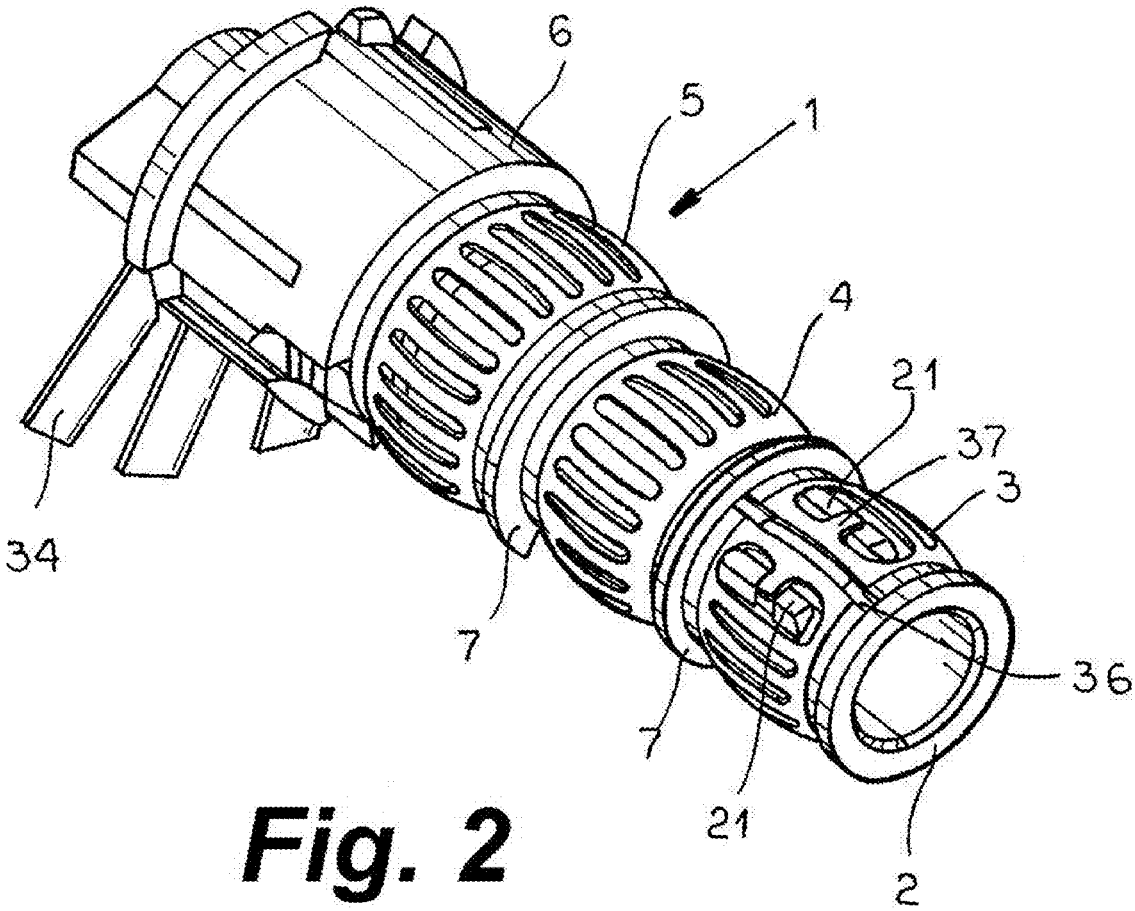
FIG. 2 is another perspective view of the connector.

The two plug-in connectors 1, rotated against one another as illustrated in FIGS. 1 and 2, are designed for connecting to a glow plug of a diesel engine, and have a circular cross section and a plastic base body 2 on which at least one strip contact, in the present illustrated embodiment three strip contacts 3, 4, 5, are coaxially provided one behind the other in the longitudinal direction. At the end of the plug-in connector 1 adjacent the contacting region a housing cap 6 is provided that has locking means, not relevant here, by which the plug-in connector 1 may be connected to another connector on the glow plug of the internal-combustion engine. If multiple strip contacts 3 through 5 are provided, they are separated by spacing rings 7 that project from the base body 2].

The design of a strip contact 3 and mounting of same to the base body 2 according to the invention is described below, and analogously applies to the additional strip contacts 4, 5.

The strip contact 3 has at its ends webs or rings 31 and 32 oriented transverse to the longitudinal direction of the plug-in connector 1, and starting at the ring 31 toward the housing cap 6 a contact strip 33 extends toward the housing cap 6, and at that location merges into a contact lug 34. A cable may be connected to this contact lug 34 to connect the plug-in connector 1 to a motor control device (not illustrated). The strip contact 3 is formed by multiple webs 35 extending longitudinally between the two rings 31 and 32. After manufacture, for example using sheet metal strips in a stamping-bending process, the strip contact 3 is open radially as by a slit 36, so that for installation on the base body 2 the strip contact may be expanded and pushed over the base body. This expansion is also necessary, for example, to allow the other strip contacts 4 and 5 to be pushed over the spacing rings 7. The slit 36 also serves to allow the strip contact 3 to pass over a projection 21, preferably multiple projections, that protrude from the base body 2. After this is done, the strip contact 3 is pressed against the base body 2 so that the projection(s) 21 can pass through an space formed by the rings 31 and 32 and the longitudinal webs 35. This at least one projection 21 is then mechanically deformed, thereby fixing the strip contact 3 in this position on the base body 2. It is then no longer possible for the strip contact 3 to lift up from the base body 2.

The portion of the figure on the right shows that, starting at the longitudinal web 35 forming the slit 36, on one side of the strip contact 3 a transverse web 37 is provided that extends into the space, and a projection 21 that protrudes from the base body 2 is provided next to the transverse web 37. The strip contact 3 is affixed to the base body 2 in a particularly satisfactory and simple manner by means of this transverse web 37 and the deformable projections 21 adjacent thereto.

A manufacturing and installation process for the plug-in connector 1 according to the invention may be provided as follows, for example:

A base body 2 made of plastic is manufactured in a plastic injection molding process, the strip contact 3 is produced from a sheet metal strip in a stamping-bending process and pre-bent, and the prefabricated strip contact 3 is pushed over the base body 2 of the plug-in connector 1 and compressed, and the projection 21 on the base body 2 that protrudes into an open area between the rings 31 and 32, and webs 35, 37 of the strip contact 3 is then mechanically shaped. The shaping is performed in such a way that the surface of the deformed projections lies on a radius which is smaller than the radius on which in particular the longitudinal webs 35 of the strip contact 3 lie.

The projections 21 protruding from the base body 2 are preferably mechanically deformed (for example, caulked using a stamping tool), so that this process may be carried out in an automated manner. In addition to this cold shaping it is also possible to heat and shape the projections 21 in such a way that they project over at least one ring 31 and 32 and web 35, 37 of the strip contact 3.

The above-referenced embodiments for the manufacture, installation, and mounting of the strip contact 3 on the base body 2 analogously apply for the case that more than one strip contact 3, namely, strip contacts 3 through 5, are provided. Depending on how many signals are to be transmitted via the plug-in connector 1 according to the invention, it is also possible for more than the referenced three strip contacts 3 through 5 to be provided.

The invention claimed is:

1. A plug-in connector for connecting to a glow plug in a diesel engine, having a circular cross section and a plastic base body on which at least one strip contact is coaxially provided, wherein the strip contact has a longitudinally extending slit and at least one protruding projection on the base body, and wherein after the strip contact is installed on the base body the projection is deformed in such a way that it projects at least partially over at least one web of the strip contact after being deformed.

2. The plug-in connector according to claim 1 wherein, starting at the slit, two parallel longitudinal webs are provided that form a space, the strip contact being provided on the base body in such a way that the projection of the base body is located in the space.

3. The plug-in connector according to claim 2 wherein, starting at the longitudinal web that forms the slit, on one side of the strip contact a transverse web is provided that extends into the space, and a projection from the base body is provided next to the transverse web.

4. The plug-in connector according to claim 1 wherein multiple strip contacts are provided in a longitudinally extending row on the base body and are each separated by a spacer ring projecting from the base body.

5. The plug-in connector according to claim 1 wherein the base body has a stepped shape in regions in which the strip contacts are provided on the base body.

* * * * *